US011528787B2

(12) United States Patent
Han et al.

(10) Patent No.: US 11,528,787 B2
(45) Date of Patent: Dec. 13, 2022

(54) CORRELATED COLOR TEMPERATURE CHANGEABLE LIGHTING APPARATUS

(71) Applicant: SAMSUNG ELECTRONICS CO., LTD., Suwon-si (KR)

(72) Inventors: Deokhee Han, Seoul (KR); Hyunjung Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 159 days.

(21) Appl. No.: 16/895,175

(22) Filed: Jun. 8, 2020

(65) Prior Publication Data

US 2021/0195707 A1 Jun. 24, 2021

(30) Foreign Application Priority Data

Dec. 18, 2019 (KR) ..... 10-2019-0170023

(51) Int. Cl.

| | |
|---|---|
| ***H05B 45/24*** | (2020.01) |
| ***H05B 47/21*** | (2020.01) |
| ***F21S 4/26*** | (2016.01) |
| *F21Y 115/10* | (2016.01) |

(52) U.S. Cl.

CPC ..... *H05B 45/24* (2020.01); *F21S 4/26* (2016.01); *H05B 47/21* (2020.01); *F21Y 2115/10* (2016.08)

(58) Field of Classification Search

CPC ..... F21Y 2115/10; H05B 47/17; H05B 45/48

See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |

(Continued)

FOREIGN PATENT DOCUMENTS

| | | | |
|---|---|---|---|
| KR | 10-1877621 | B1 | 7/2018 |
| KR | 10-1965249 | B1 | 4/2019 |
| KR | 10-1995254 | B1 | 6/2019 |

OTHER PUBLICATIONS

Samsung New ACOM Solutions Overview, Rev 1.0, Jun. 2019.

*Primary Examiner* — Kurtis R Bahr

(74) *Attorney, Agent, or Firm* — Lee IP Law, P.C.

(57) ABSTRACT

A light-emitting circuit includes first and second light-emitting element strings respectively configured to emit light having a first and second color temperatures; a rectifying circuit configured to rectify a voltage, input by an alternating current (AC) power source, to generate a driving voltage; a string switching circuit configured to select at least one light-emitting element string to be used for light emission from among the first light-emitting element string and the second light-emitting element string; an off/on sensing circuit configured to change a selection of the string switching circuit to change a color temperature of light, which is emitted by the light-emitting circuit, when the AC power source is turned off and then turned on; and a driving circuit configured to turn on, in turn, light-emitting elements in the selected at least one light-emitting element string, according to a change in the driving voltage over time.

18 Claims, 10 Drawing Sheets

(56) References Cited

U.S. PATENT DOCUMENTS

| | | | | |
|---|---|---|---|---|
| 6,967,353 | B2 | 11/2005 | Suzuki et al. | |
| 7,002,182 | B2 | 2/2006 | Okuyama et al. | |
| 7,084,420 | B2 | 8/2006 | Kim et al. | |
| 7,087,932 | B2 | 8/2006 | Okuyama et al. | |
| 7,154,124 | B2 | 12/2006 | Han et al. | |
| 7,208,725 | B2 | 4/2007 | Sherrer et al. | |
| 7,288,758 | B2 | 10/2007 | Sherrer et al. | |
| 7,319,044 | B2 | 1/2008 | Han et al. | |
| 7,501,656 | B2 | 3/2009 | Han et al. | |
| 7,709,857 | B2 | 5/2010 | Kim et al. | |
| 7,759,140 | B2 | 7/2010 | Lee et al. | |
| 7,781,727 | B2 | 8/2010 | Sherrer et al. | |
| 7,790,482 | B2 | 9/2010 | Han et al. | |
| 7,940,350 | B2 | 5/2011 | Jeong | |
| 7,959,312 | B2 | 6/2011 | Yoo et al. | |
| 7,964,881 | B2 | 6/2011 | Choi et al. | |
| 7,985,976 | B2 | 7/2011 | Choi et al. | |
| 7,994,525 | B2 | 8/2011 | Lee et al. | |
| 8,008,683 | B2 | 8/2011 | Choi et al. | |
| 8,013,352 | B2 | 9/2011 | Lee et al. | |
| 8,049,161 | B2 | 11/2011 | Sherrer et al. | |
| 8,129,711 | B2 | 3/2012 | Kang et al. | |
| 8,179,938 | B2 | 5/2012 | Kim | |
| 8,263,987 | B2 | 9/2012 | Choi et al. | |
| 8,324,646 | B2 | 12/2012 | Lee et al. | |
| 8,399,944 | B2 | 3/2013 | Kwak et al. | |
| 8,432,511 | B2 | 4/2013 | Jeong | |
| 8,459,832 | B2 | 6/2013 | Kim | |
| 8,502,242 | B2 | 8/2013 | Kim | |
| 8,536,604 | B2 | 9/2013 | Kwak et al. | |
| 8,669,722 | B2 | 3/2014 | Yeh et al. | |
| 8,735,931 | B2 | 5/2014 | Han et al. | |
| 8,766,295 | B2 | 7/2014 | Kim | |
| 9,655,183 | B2 * | 5/2017 | Krijn | H05B 45/44 |
| 9,686,833 | B2 * | 6/2017 | Bong | H05B 45/20 |
| 9,860,955 | B2 | 1/2018 | Kim et al. | |
| 9,907,132 | B2 | 2/2018 | Zulim et al. | |
| 10,389,226 | B1 * | 8/2019 | Pastore | H02M 1/14 |
| 10,499,471 | B2 | 12/2019 | Bong et al. | |
| 2012/0299490 | A1 * | 11/2012 | Lee | H05B 45/44 315/191 |
| 2013/0082616 | A1 * | 4/2013 | Bradford | H05B 45/58 315/193 |
| 2013/0200814 | A1 * | 8/2013 | Chen | H05B 47/185 315/210 |
| 2014/0226095 | A1 * | 8/2014 | Scott | G02B 30/23 349/15 |
| 2015/0282260 | A1 * | 10/2015 | Hussell | H01L 25/50 438/23 |
| 2016/0037601 | A1 * | 2/2016 | Zhang | H05B 45/44 315/191 |
| 2016/0255683 | A1 * | 9/2016 | Wu | H05B 45/20 315/192 |
| 2016/0366731 | A1 * | 12/2016 | Palfreyman | H05B 45/395 |
| 2018/0249547 | A1 * | 8/2018 | Wang | H05B 45/48 |
| 2019/0320513 | A1 * | 10/2019 | Bong | H05B 45/20 |
| 2019/0353332 | A1 * | 11/2019 | You | F21V 15/01 |

* cited by examiner

FIG. 3

| | FIRST MODE | SECOND MODE | THIRD MODE |
|---|---|---|---|
| FIRST STRING SWITCHING CIRCUIT | ON | OFF | ON |
| SECOND STRING SWITCHING CIRCUIT | OFF | ON | ON |
| CCT | FIRST CCT | SECOND CCT | THIRD CCT |

CORRELATED COLOR TEMPERATURE CHANGEABLE LIGHTING APPARATUS

CROSS-REFERENCE TO RELATED APPLICATION

Korean Patent Application No. 10-2019-0170023, filed on Dec. 18, 2019, in the Korean Intellectual Property Office, and entitled: "Correlated Color Temperature Changeable Lighting Apparatus," is incorporated by reference herein in its entirety.

BACKGROUND

1. Field

Embodiments relate to a correlated color temperature (CCT) changeable lighting apparatus.

2. Description of the Related Art

A CCT value may be assigned as a point of reference for a color temperature or "warmth" of light from a light source. Lighting used for human workspaces (e.g., office spaces, residences, area lighting, etc.) often has a CCT value of about 2700 Kelvin (K) (warm) to 6500 K (cool), although this is not an exclusive range. Light that has a relatively low CCT value, e.g., 2700 K or 3000 K may generally be perceived as having a warmer color temperature than light that has a relatively high CCT value, e.g., 4500 K or higher.

SUMMARY

Embodiments are directed to a lighting apparatus including: a light-emitting circuit including a first light-emitting element string configured to emit light having a first color temperature and a second light-emitting element string configured to emit light having a second color temperature different from the first color temperature; a rectifying circuit configured to rectify a voltage, input by an alternating current (AC) power source, to generate a driving voltage; a string switching circuit configured to select at least one light-emitting element string to be used for light emission from among the first light-emitting element string and the second light-emitting element string; an off/on sensing circuit configured to change a selection of the string switching circuit to change a color temperature of light, which is emitted by the light-emitting circuit, when the AC power source is turned off and then turned on; and a driving circuit configured to turn on, in turn, light-emitting elements in the selected at least one light-emitting element string, according to a change in the driving voltage over time.

Embodiments are also directed to a lighting apparatus, including a light-emitting circuit including a plurality of light-emitting element strings configured to emit light having respectively different color temperatures, each of the plurality of light-emitting element strings having a first end connected to a ground node; a string switching circuit configurable to be in an on or off state, wherein, in the on state, a second end of each of the plurality of light-emitting element strings is connected to a driving node, and, in the off state, the second end of each of the plurality of light-emitting element strings is not connected to the driving node; and an off/on sensing circuit configured to detect an off/on signal in which an alternating current (AC) power source is turned off and then turned on, and to change the state of the string switching circuit when the off/on signal is detected. An output mode of the lighting apparatus may be one of a plurality of modes in which color temperatures of light emitted by the light-emitting circuit are different from each other, and the output mode of the lighting apparatus may be changed to another one of the plurality of modes by the off/on signal.

Embodiments are also directed to a lighting apparatus, including: a light-emitting circuit including a first light-emitting element string configured to emit light having a first color temperature and a second light-emitting element string configured to emit light having a second color temperature different from the first color temperature; a first string switching circuit configurable to be in an on or off state, wherein, in the on state, the first light-emitting element string is connected to a driving node, and, in the off state, the first light-emitting element string is not connected to the driving node; a second string switching circuit configurable to be in an on or off state, wherein, in the on state, the second light-emitting element string is connected to the driving node, and, in the off state, the second light-emitting element string is not connected to the driving node; and an on/off sensing circuit configured to control the states of the first string switching circuit and the second string switching circuit. An output mode of the lighting apparatus may be one of a first mode in which only the first string switching circuit is in the on state, a second mode in which only the second string switching circuit is in the on state, and a third mode in which both the first string switching circuit and the second string switching circuit are in the on states, and the on/off sensing circuit may change the state of at least one of the first string switching circuit and the second string switching circuit, so as to change the output mode of the lighting apparatus to another one of the first to third modes, according to a predetermined order when an off/on signal, in which an alternating current power source is turned off and then turned on, is detected.

BRIEF DESCRIPTION OF THE DRAWINGS

Features will become apparent to those of skill in the art by describing in detail example embodiments with reference to the attached drawings in which:

FIG. 3 is a table for describing the operation of a lighting apparatus according to an example embodiment:

DETAILED DESCRIPTION

Herein, the term "connected," e.g., where two elements are "connected," generally refers to the two elements being electrically connected, and encompasses the two elements being directly connected, as well as the two elements being connected through other elements(s) between the two elements.

Figure 1:
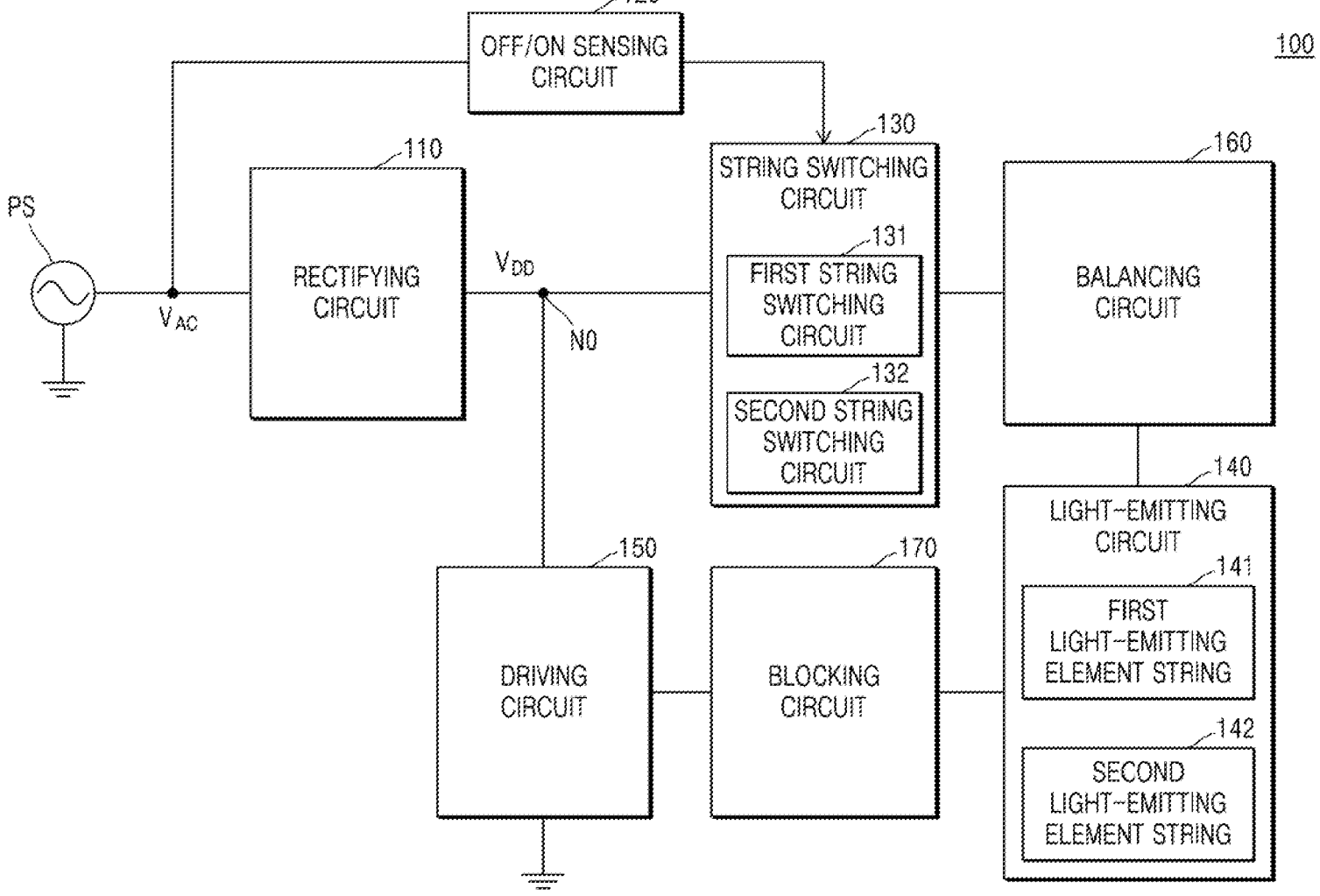
FIG. 1 is a block diagram of a lighting apparatus according to an example embodiment.
Figure 2:
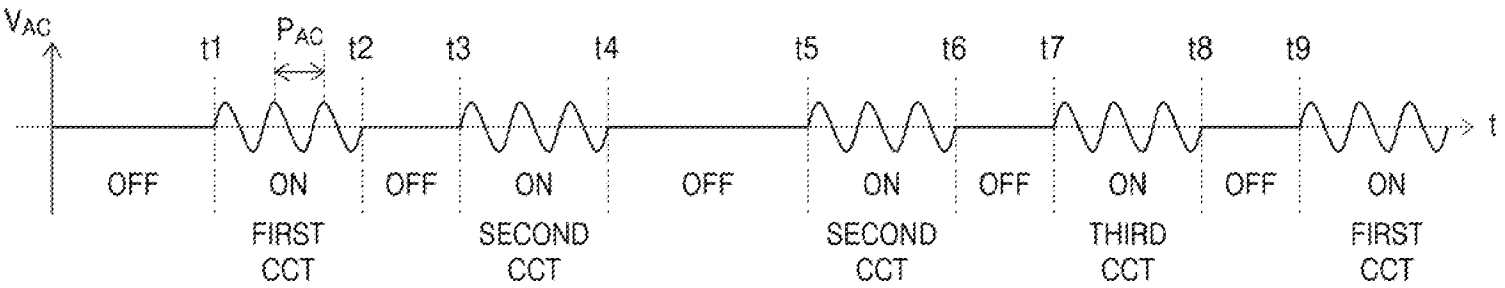
FIG. 2 is a graph showing an example of voltage input from an alternating current (AC) power source as a function of time.
Figure 4:
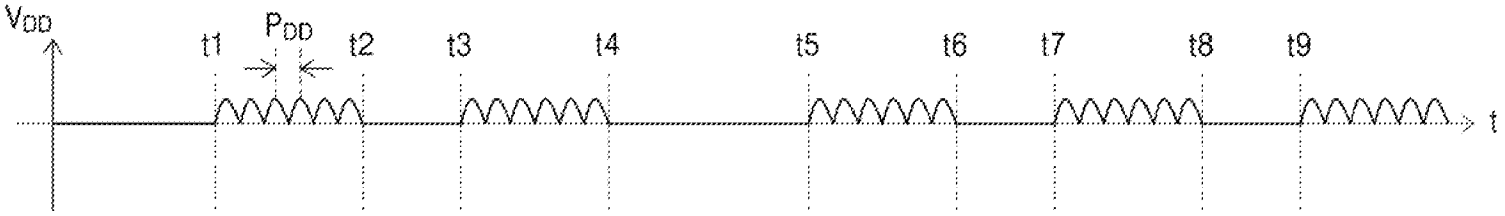
FIG. 4 is a graph exemplarily showing a driving voltage as a function of time.

FIG. 1 is a block diagram of a lighting apparatus 100 according to an example embodiment. FIG. 2 is a graph exemplarily showing a voltage $V_{AC}$ input from an alternating current (AC) power source PS as a function of time t. FIG. 3 is a table for describing the operation of the lighting apparatus 100 according to the embodiment. FIG. 4 is a graph exemplarily showing a driving voltage $V_{DD}$ as a function of time t.

Referring to FIG. 1, the lighting apparatus 100 may include a light-emitting circuit 140, a string switching circuit 130 connected to the light-emitting circuit 140, and an off/on sensing circuit 120 configured to control the string switching circuit 130.

The light-emitting circuit 140 may include a plurality of light-emitting element strings emitting light having different color temperatures. For example, the light-emitting circuit 140 may include a first light-emitting element string 141 configured to emit light having a first color temperature, and a second light-emitting element string 142 configured to emit light having a second color temperature. For example, the first color temperature may be about 2500 K to about 3000 K, and the second color temperature may be about 4500 K to about 6500 K. The light-emitting circuit 140 may include three or more light-emitting element strings.

The string switching circuit 130 may select at least one light-emitting element string to be used for light emission from among the plurality of light-emitting element strings (e.g., from among the first and second light-emitting element strings 141 and 142) in the light-emitting circuit 140. For example, the string switching circuit 130 may selectively connect the first and/or second light-emitting element strings 141 and 142 in the light-emitting circuit 140 to a driving node N0.

In an example embodiment, the string switching circuit 130 may include a plurality of string switching circuits. For example, the string switching circuit 130 may include a first string switching circuit 131 configured to selectively connect the first light-emitting element string 141 to the driving node N0, and a second string switching circuit 132 configured to selectively connect the second light-emitting element string 142 to the driving node N0.

The output mode of the lighting apparatus 100 may be a selected one of a plurality of modes in which color temperatures of light emitted by the light-emitting circuit 140 are different from each other. For example, as shown in FIG. 3, the output mode of the lighting apparatus 100 may be one of a first mode in which the light-emitting circuit 140 emits light having a first color temperature, a second mode in which the light-emitting circuit 140 emits light having a second color temperature, and a third mode in which the light-emitting circuit 140 emits light having a third color temperature.

When the output mode of the lighting apparatus 100 is the first mode, the first string switching circuit 131 may be on and the second string switching circuit 132 may be off, and thus, only the first light-emitting element string 141 may be connected to the driving node N0 and the light-emitting circuit 140 may emit light having the first color temperature by using only the first light-emitting element string 141. When the output mode of the lighting apparatus 100 is the second mode, the second string switching circuit 132 may be on and the first string switching circuit 131 may be off, and thus, only the second light-emitting element string 142 may be connected to the driving node N0 and the light-emitting circuit 140 may emit light having the second color temperature by using only the second light-emitting element string 142. When the output mode of the lighting apparatus 100 is the third mode, both the first string switching circuit 131 and the second string switching circuit 132 may be on, and thus, both the first light-emitting element string 141 and the second light-emitting element string 142 may be connected to the driving node N0 and the light-emitting circuit 140 may emit light having the third color temperature between the first color temperature and the second color temperature by using both the first light-emitting element string 141 and the second light-emitting element string 142.

An AC power source PS may be connected to the lighting apparatus 100. The AC power source PS may have the voltage $V_{AC}$ as shown in FIG. 2. The voltage $V_{AC}$ input from the AC power source PS may be, for example, a sine wave having a constant period $P_{AC}$ and a constant frequency.

The AC power source PS may be in an off state in which the AC power source PS is not on or connected to the lighting apparatus 100, or an on state in which the AC power source PS is on or connected to the lighting apparatus 100. For example, referring to FIG. 2, the AC power source PS may be in the off state for a time between 0 and t1, between t2 and t3, between t4 and t5, between t6 and t7, and between t8 and t9, and may be in the on state for a time between t1 and t2, between t3 and t4, between t5 and t6, between t7 and t8, and after t9. Thus, the AC power source PS may be turned on at t1, turned off at t2, turned on at t3, turned off at t4, turned on at t5, turned off at t6, turned on at t7, turned off at t8, and turned on at t9.

The off/on sensing circuit 120 may detect an off/on signal in which the AC power source PS is turned off and then turned on, and may change the state of the string switching circuit 130 to change the output mode of the lighting apparatus 100 to change the color temperature of light emitted from the light-emitting circuit 140 when the off/on signal is detected. The off/on sensing circuit 120 may change the state of the string switching circuit 130 by selectively providing an off voltage to the string switching circuit 130.

For example, when the AC power source PS is turned off at t2 and then turned on at t3, the off/on sensing circuit 120 may change the state of the string switching circuit 130 to change the output mode of the lighting apparatus 100 from the first mode to the second mode. In an example embodiment, the output mode of the lighting apparatus 100 may be changed in a predetermined order. For example, the output mode of the lighting apparatus 100 may be changed in the order of first mode→second mode→third mode→first mode→second mode, or in the order of first mode→third mode→second mode→first mode→third mode. In another example embodiment, the output mode of the lighting apparatus 100 may be randomly changed.

In an example embodiment, the off/on sensing circuit 120 may change the state of the string switching circuit 130 only when the AC power source PS is turned on within a predetermined time after being turned off, and the color temperature of light emitted from the light-emitting circuit 140 may be changed and the output mode of the lighting apparatus 100 may be changed. On the other hand, when the AC power source PS is turned off and then turned on after a predetermined time, the off/on sensing circuit 120 may not change the state of the string switching circuit 130, and the color temperature of light emitted from the light-emitting circuit 140 may not be changed and the output mode of the lighting apparatus 100 may not be changed. In an example embodiment, the predetermined time may be greater than the period $P_{AC}$ of the voltage $V_{AC}$ of the AC power source PS. The predetermined time may be, for example, in the range of about 1 millisecond (ms) to about 1 second (s).

For example, referring to FIG. 2, because the AC power source PS is turned on at t3 before a certain time passes after the AC power source PS is turned off at t2, the output mode of the lighting apparatus 100 may be changed from the first mode to the second mode and thus the color temperature of light emitted from the light-emitting circuit 140 may be changed from the first color temperature to the second color temperature. On the other hand, because the AC power source PS is turned on at t5 after a predetermined time passes after the AC power source PS is turned off at t4, the output mode of the lighting apparatus 100 may be still maintained in the second mode and thus the color temperature of light emitted from the light-emitting circuit 140 may also be maintained at the second color temperature. Similarly, because the AC power source PS is turned on at t7 before a certain time passes after the AC power source PS is turned off at t6, the output mode of the lighting apparatus 100 may be changed from the second mode to the third mode and thus the color temperature of light emitted from the light-emitting circuit 140 may be changed from the second color temperature to the third color temperature. Likewise, because the AC power source PS is turned on at t9 before a predetermined time passes after the AC power source PS is turned off at t8, the output mode of the lighting apparatus 100 may be changed from the third mode to the first mode and thus the color temperature of light emitted from the light-emitting circuit 140 may be changed from the third color temperature to the first color temperature.

In an example embodiment, the user may change the color temperature of the lighting apparatus 100 by using an on/off button or switch for turning on or off the lighting apparatus 100. When the user wants to change the color temperature, the user may turn on the lighting apparatus 100 by pressing the on/off button within a short time after turning off the lighting apparatus 100 by pressing the on/off button. In another example embodiment, the user may change the color temperature of the lighting apparatus 100 by using a color temperature change button provided in addition to the on/off button. The lighting apparatus 100 may be designed to automatically generate an on/off signal when the user presses the color temperature change button to change the color temperature.

Referring back to FIG. 1, in an example embodiment, the lighting apparatus 100 may further include a balancing circuit 160 between the string switching circuit 130 and the light-emitting circuit 140. The balancing circuit 160 may adjust the color temperature of light obtained by mixing light emitted from two of the plurality of light-emitting element strings (e.g., the first and second light-emitting element strings 141 and 142) in the light-emitting circuit 140. For example, the balancing circuit 160 may adjust the third color temperature of light emitted from the light-emitting circuit 140 when both the first light-emitting element string 141 and the second light-emitting element string 142 are turned on. For example, the balancing circuit 160 may adjust the ratio of the intensity of light emitted from the second light-emitting element string 142 to the intensity of light emitted from the first light-emitting element string 141 when both the first light-emitting element string 141 and the second light-emitting element string 142 are turned on.

In an example embodiment, the lighting apparatus 100 may further include a rectifying circuit 110 capable of rectifying the voltage $V_{AC}$ input from the AC power source PS to generate the driving voltage $V_{DD}$. The driving voltage $V_{DD}$ may be provided to the driving node N0.

FIG. 4 illustrates an example driving voltage $V_{DD}$ that may be generated by rectifying the voltage $V_{AC}$ input by the example AC power source PS shown in FIG. 2. In an example embodiment, the rectifying circuit 110 may full-wave rectify the voltage $V_{AC}$ input by the AC power source PS to generate the driving voltage $V_{DD}$, and a period $P_{DD}$ of the driving voltage $V_{DD}$ may be half of the period $P_{AC}$ of the voltage $V_{AC}$ that is an AC voltage.

Referring again to FIG. 1, in an example embodiment, the lighting apparatus 100 may further include a driving circuit 150 that drives the light-emitting circuit 140 by using the driving voltage $V_{DD}$. The lighting apparatus 100 may drive all of the plurality of light-emitting element strings (e.g., the first and second light-emitting element strings 141 and 142) of the light-emitting circuit 140 by using one driving circuit 150. Thus, the lighting apparatus 100 may further reduce costs as compared to a lighting apparatus that uses a respective driving circuit for each light-emitting element string. The lighting apparatus 100 using an AC voltage (i.e., the voltage $V_{AC}$ other than a DC voltage) may be referred to as an AC direct driving circuit. That is, a lighting apparatus like the lighting apparatus 100 that does not convert an AC voltage (i.e., the voltage $V_{AC}$) into a DC voltage may be referred to as an AC direct lighting apparatus. The AC direct lighting apparatus may not require an AC-to-DC converter, and thus, may be cheaper and have a smaller size.

In an example embodiment, the lighting apparatus 100 may further include a blocking circuit 170 between the light-emitting circuit 140 and the driving circuit 150. When the plurality of light-emitting element strings (e.g., the first and second light-emitting element strings 141 and 142) are connected to one driving circuit 150, the blocking circuit 170 may prevent light-emitting elements of a light-emitting element string that is not selected (e.g., not selected by the string switching circuit 130) from being turned on. Accordingly, the blocking circuit 170 may help drive the plurality of light-emitting element strings (e.g., the first and second light-emitting element strings 141 and 142) by using one driving circuit 150.

Figure 5:
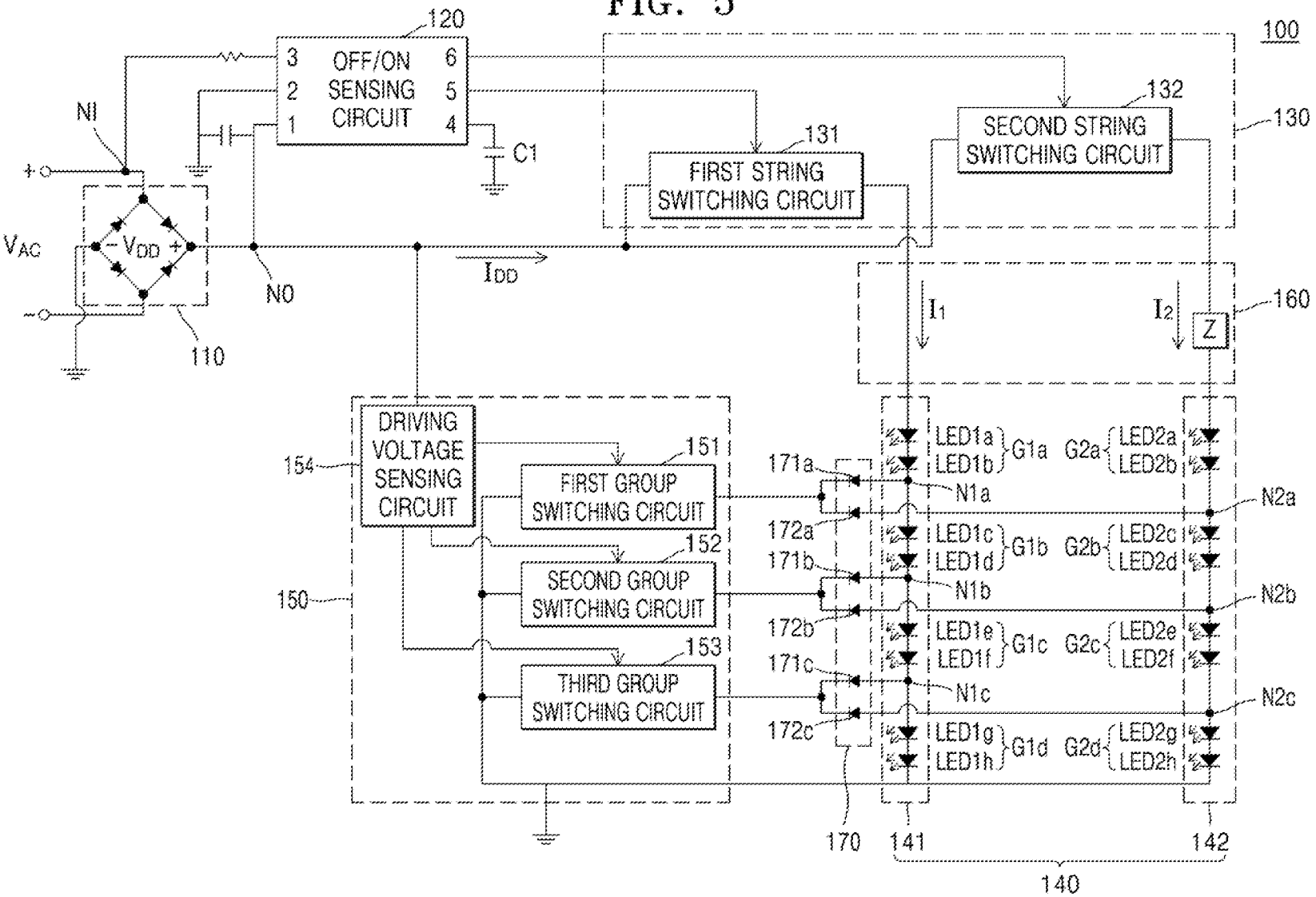
FIG. 5 is a circuit diagram of a lighting apparatus according to an example embodiment.
Figure 6:
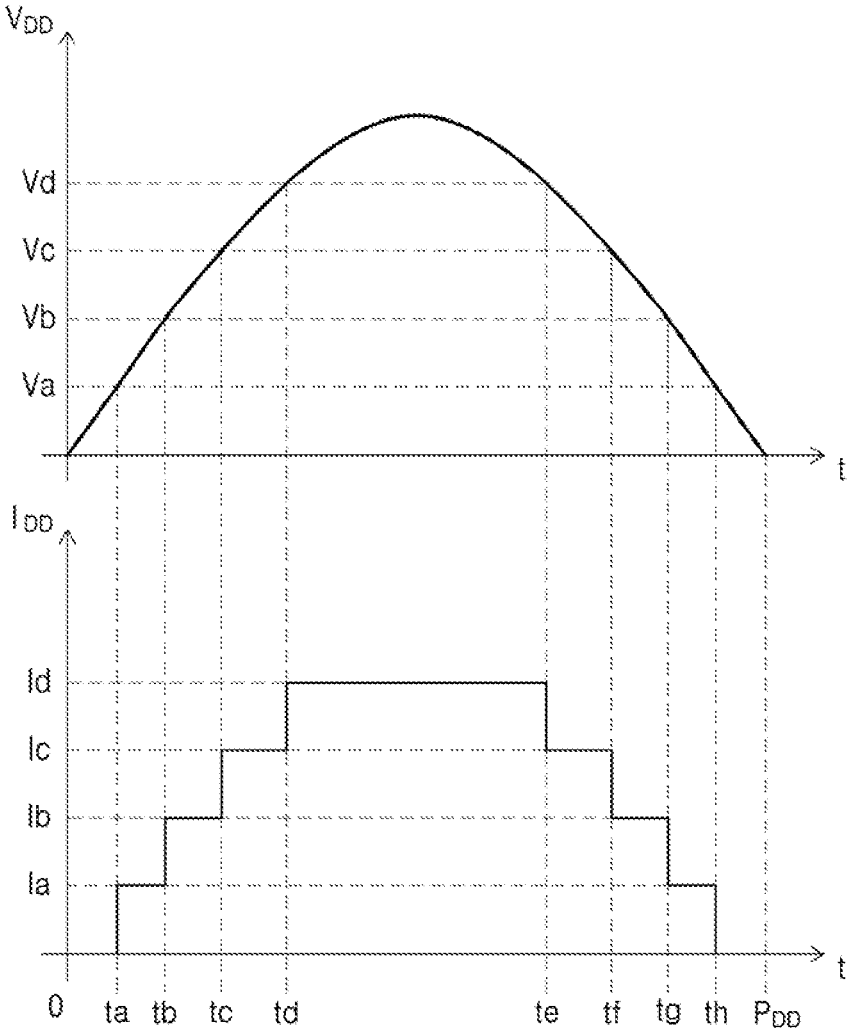
FIG. 6 is a graph for describing a driving circuit included in a lighting apparatus according to an example embodiment.

FIG. 5 is a circuit diagram of a lighting apparatus 100 according to an example embodiment. FIG. 6 is a graph for describing a driving circuit 150 included in the lighting apparatus 100 according to the embodiment.

Referring to FIG. 5, a light-emitting circuit 140 may include a plurality of light-emitting element strings, e.g., a first light-emitting element string 141 and a second light-emitting element string 142. One end of each of the first light-emitting element string 141 and the second light-emitting element string 142 may be grounded. The first light-emitting element string 141 may include a plurality of light-emitting elements LED1*a* to LED1*h* connected in series. The second light-emitting element string 142 may include a plurality of light-emitting elements LED2*a* to LED2*h* connected in series. In an example embodiment, each of the light-emitting elements LED1*a* to LED1*h* in the first light-emitting element string 141 may be a light-emitting diode that emits light having a first color temperature, and each of the light-emitting elements LED2*a* to LED2*h* in the second light-emitting element string 142 may be a light-emitting diode that emits light having a second color temperature.

The off/on sensing circuit 120 may have, e.g., six terminals. A first terminal of the off/on sensing circuit 120 may be connected to the driving node N0. A second terminal of the off/on sensing circuit 120 may be grounded. A third terminal of the off/on sensing circuit 120 may be connected to an input node NI to detect the voltage $V_{AC}$ input from an AC power source. In a different embodiment, the off/on sensing circuit 120 may not be connected to the input node NI and may indirectly detect the turn-on of the AC power source, the turn-off of the AC power source, and a time between the turn-on and turn-off by detecting a driving voltage $V_{DD}$ provided from the driving node N0 connected to the first terminal of the off/on sensing circuit 120. A fourth terminal of the off/on sensing circuit 120 may be connected to a capacitor C1 for determining the predetermined time that is a reference for changing an output mode of the lighting apparatus 100. A fifth terminal of the off/on sensing circuit 120 may be connected to the first string switching circuit 131. A sixth terminal of the off/on sensing circuit 120 may be connected to the second string switching circuit 132.

The string switching circuit 130 may include the first string switching circuit 131, which selectively connects the other end of the first light-emitting element string 141 to the driving node N0, and the second string switching circuit 132, which selectively connects the other end of the second light-emitting element string 142 to the driving node N0. Each of the first string switching circuit 131 and the second string switching circuit 132 may include, for example, circuits shown in FIGS. 7 and 8, which will be described below.

In an example embodiment, the first string switching circuit 131 may be in an off state when the off/on sensing circuit 120 provides an off voltage (e.g., 0 volts) to the first string switching circuit 131, and may be in an on state when the off/on sensing circuit 120 does not provide the off voltage to the first string switching circuit 131. Likewise, the second string switching circuit 132 may be in an off state when the off/on sensing circuit 120 provides an off voltage (e.g., 0 volts) to the second string switching circuit 132, and may be in an on state when the off/on sensing circuit 120 does not provide the off voltage to the second string switching circuit 132.

When the output mode of the lighting apparatus 100 is a first mode, only the first string switching circuit 131 may be turned on, the driving node N0 may be connected only to the first light-emitting element string 141, and a driving current $I_{DD}$ may be provided only to the first light-emitting element string 141. Accordingly, a current $I_1$ provided to the first light-emitting element string 141 may be equal to the driving current $I_{DD}$ and a current $I_2$ provided to the second light-emitting element string 142 may be zero ($I_1=I_{DD}$ and $I_2=0$). When the output mode of the lighting apparatus 100 is a second mode, only the second string switching circuit 132 may be turned on, the driving node N0 may be connected only to the second light-emitting element string 142, and the driving current $I_{DD}$ may be provided only to the second light-emitting element string 142. Accordingly, the current $I_1$ provided to the first light-emitting element string 141 may be zero and the current $I_2$ provided to the second light-emitting element string 142 may be equal to the driving current $I_{DD}$ ($I_1=0$ and $I_2=I_{DD}$). When the output mode of the lighting apparatus 100 is a third mode, both the first string switching circuit 131 and the second string switching circuit 132 may be turned on, the driving node N0 may be connected to both the first light-emitting element string 141 and the second light-emitting element string 142, and the driving current $I_{DD}$ may be divided into two currents such that the two currents are provided to the first light-emitting element string 141 and the second light-emitting element string 142, respectively. Accordingly, the sum of the current $I_1$ provided to the first light-emitting element string 141 and the current $I_2$ provided to the second light-emitting element string 142 may be equal to the driving current $I_{DD}$ ($I_1+I_2=I_{DD}$).

The balancing circuit 160 may control the ratio of the intensity of light emitted from the first light-emitting element string 141 to the intensity of light emitted from the second light-emitting element string 142 by controlling the ratio (i.e., $I_1:I_2$) of the current $I_1$ provided to the first light-emitting element string 141 to the current $I_2$ provided to the second light-emitting element string 142 when the output mode of the lighting apparatus 100 is the third mode, and thus, may further control the third color temperature between the first and second color temperatures. The balancing circuit 160 may be connected between the string switching circuit 130 and the light-emitting circuit 140. In an example embodiment, the balancing circuit 160 may include an impedance element Z connected between the second string switching circuit 132 and the second light-emitting element string 142. The impedance element Z may, for example, relatively reduce the current $I_2$ provided to the second light-emitting element string 142 and relatively increase the current $I_1$ provided to the first light-emitting element string 141, and thus, the third color temperature may be adjusted to be closer to the first color temperature. The impedance element Z may include a suitable element having impedance, for example, a resistor, a capacitor, an inductor, a diode, a light-emitting diode, or a combination thereof.

The rectifying circuit 110 may rectify the voltage $V_{AC}$ input from the AC power source to provide the driving voltage $V_{DD}$ to the driving node N0. The rectifying circuit 110 may include, for example, a full wave bridge circuit including a plurality of diodes, as shown in FIG. 5.

Referring to FIGS. 5 and 6, the driving circuit 150 may receive the driving voltage $V_{DD}$ and may be configured to turn on, in turn, light-emitting elements in at least one light-emitting element string, selected by the string switching circuit 130, according to a change in the driving voltage $V_{DD}$ over time t. In addition, the driving circuit 150 may change the driving current $I_{DD}$ stepwise according to a change in the driving voltage $V_{DD}$ over time t.

The first light-emitting element string 141 may include a plurality of light-emitting element groups G1*a* to G1*d* connected in series and a plurality of group nodes N1*a* to N1*c* between the plurality of light-emitting element groups G1*a* to G1*d*. The second light-emitting element string 142 may include a plurality of light-emitting element groups G2*a* to G2*d* connected in series and a plurality of group nodes N2*a* to N2*c* between the plurality of light-emitting element groups G2*a* to G2*d*. The driving circuit 150 may be connected to the plurality of group nodes N1*a* to N1*c* and N2*a* to N2*c*.

In an example embodiment, the driving circuit 150 may include a plurality of group switching circuits, e.g., first to third group switching circuits 151 to 153, and a driving voltage sensing circuit 154 configured to control the plurality of group switching circuits. The first group switching circuit 151 may selectively connect a first group node N1*a* of the first light-emitting element string 141 and a first group node N2*a* of the second light-emitting element string 142 to a ground node. The second group switching circuit 152 may selectively connect a second group node N1*b* of the first light-emitting element string 141 and a second group node N2*b* of the second light-emitting element string 142 to the ground node. The third group switching circuit 153 may selectively connect a third group node N1*c* of the first light-emitting element string 141 and a third group node N2*c* of the second light-emitting element string 142 to the ground node. The driving voltage sensing circuit 154 may detect the driving voltage $V_{DD}$ and control the first to third group switching circuits 151 to 153 according to a change in the magnitude of the driving voltage $V_{DD}$ over time t.

The driving voltage $V_{DD}$ may have a waveform having a period $P_{DD}$. The magnitude of the driving voltage $V_{DD}$ during a time between 0 and ta may be small to turn on one light-emitting element group G1*a* in the first light-emitting element string 141 and one light-emitting element group G2*a* in the second light-emitting element string 142. Accordingly, all of the light-emitting element groups G1*a* to G1*d* in the first light-emitting element string 141 and all of the light-emitting element groups G2*a* to G2*d* in the second light-emitting element string 142 may be in an off state for the time between 0 and ta.

The magnitude of the driving voltage $V_{DD}$ during a time between ta and tb may be sufficient to turn on one light-emitting element group G1*a* in the first light-emitting element string 141 and one light-emitting element group G2*a* in the second light-emitting element string 142, but may be too small to turn on two light-emitting element groups G1*a* and G1*b* in the first light-emitting element string 141 and two light-emitting element groups G2*a* and G2*b* in the second light-emitting element string 142. Accordingly, at ta, the driving voltage sensing circuit 154 may turn on only the first group switching circuit 151. Accordingly, the current $I_1$ entering the first light-emitting element string 141 may not flow to the second light-emitting element group G1*b* in the first light-emitting element string 141 but may flow to the driving circuit 150 through the first group node N1*a* in the first light-emitting element string 141. Likewise, the current $I_2$ entering the second light-emitting element string 142 may not flow to the second light-emitting element group G2*b* in the second light-emitting element string 142 but may flow to the driving circuit 150 through the first group node N2*a* in the second light-emitting element string 142. Therefore, only the first light-emitting element group G1*a* in the first light-emitting element string 141 and/or the first light-emitting element group G2*a* in the second light-emitting element string 142 may be turned on. In addition, during a time between ta and tb, the driving circuit 150 may provide a driving current $I_{DD}$ of a constant first current Ia to the light-emitting circuit 140.

The magnitude of the driving voltage $V_{DD}$ during a time between tb and tc may be sufficient to turn on two light-emitting element groups G1*a* and G1*b* in the first light-emitting element string 141 and two light-emitting element groups G2*a* and G2*b* in the second light-emitting element string 142, but may be small to turn on three light-emitting element groups G1*a* to and G1*c* in the first light-emitting element string 141 and three light-emitting element groups G2*a* to G2*c* in the second light-emitting element string 142. Accordingly, at tb, the driving voltage sensing circuit 154 may turn on only the second group switching circuit 152. Accordingly, the current $I_1$ entering the first light-emitting element string 141 may not flow to the third light-emitting element group G1*c* in the first light-emitting element string 141 but may flow to the driving circuit 150 through the second group node N1*b* in the first light-emitting element string 141. Likewise, the current $I_2$ entering the second light-emitting element string 142 may not flow to the third light-emitting element group G2*c* in the second light-emitting element string 142 but may flow to the driving circuit 150 through the second group node N2*b* in the second light-emitting element string 142. Therefore, only the first and second light-emitting element groups G1*a* and G1*b* in the first light-emitting element string 141 and/or the first and second light-emitting element groups G2*a* and G2*b* in the second light-emitting element string 142 may be turned on. In addition, during a time between tb and tc, the driving circuit 150 may provide a driving current $I_{DD}$ of a constant second current Ib to the light-emitting circuit 140.

The magnitude of the driving voltage $V_{DD}$ during a time between tc and td may be sufficient to turn on three light-emitting element groups G1*a* to G1*c* in the first light-emitting element string 141 and three light-emitting element groups G2*a* to G2*c* in the second light-emitting element string 142, but may be small to turn on all of the light-emitting element groups G1*a* to G1*d* in the first light-emitting element string 141 and all of the light-emitting element groups G2*a* to G2*d* in the second light-emitting element string 142. Accordingly, at tc, the driving voltage sensing circuit 154 may turn on only the third group switching circuit 153. Accordingly, the current $I_1$ entering the first light-emitting element string 141 may not flow to the fourth light-emitting element group G1*d* in the first light-emitting element string 141 but may flow to the driving circuit 150 through the third group node N1*c* in the first light-emitting element string 141. Likewise, the current $I_2$ entering the second light-emitting element string 142 may not flow to the fourth light-emitting element group G2*d* in the second light-emitting element string 142 but may flow to the driving circuit 150 through the third group node N2*c* in the second light-emitting element string 142. Therefore, only the first to third light-emitting element groups G1*a* to G1*c* in the first light-emitting element string 141 and/or the first to third light-emitting element groups G2*a* to G2*c* in the second light-emitting element string 142 may be turned on. In addition, during a time between tc and td, the driving circuit 150 may provide a driving current $I_{DD}$ of a constant third current Ic to the light-emitting circuit 140.

The magnitude of the driving voltage $V_{DD}$ during a time between td and te may be sufficient to turn on all of the light-emitting element groups G1*a* to G1*d* in the first light-emitting element string 141 and all of the light-emitting element groups G2*a* to G2*d* in the second light-emitting element string 142. Accordingly, all of the first to third group switching circuits 151 to 153 may be turned off. Accordingly, the current $I_1$ entering the first light-emitting element string 141 may flow through all of the first to fourth light-emitting element groups G1*a* to G1*d* in the first light-emitting element string 141. Likewise, the current $I_2$ entering the second light-emitting element string 142 may flow through all of the first to fourth light-emitting element groups G2*a* to G2*d* in the second light-emitting element string 142. Therefore, all of the first to fourth light-emitting element groups G1*a* to G1*d* in the first light-emitting element string 141 and/or all of the first to fourth light-emitting element groups G2*a* to G2*d* in the second light-emitting element string 142 may be turned on. In addition, during a time between td and te, the driving circuit 150 may provide a driving current $I_{DD}$ of a constant fourth current Id to the light-emitting circuit 140.

The magnitude of the driving voltage $V_{DD}$ during a time between te and tf may be sufficient to turn on three light-emitting element groups G1*a* to G1*c* in the first light-emitting element string 141 and three light-emitting element groups G2*a* to G2*c* in the second light-emitting element string 142, but may be too small to turn on all of the light-emitting element groups G1*a* to G1*d* in the first light-emitting element string 141 and all of the light-emitting element groups G2*a* to G2*d* in the second light-emitting element string 142. Accordingly, at te, the driving voltage sensing circuit 154 may turn on only the third group switching circuit 153. Accordingly, the current $I_1$ entering the first light-emitting element string 141 may not flow to the fourth light-emitting element group G1*d* in the first light-emitting element string 141 but may flow to the driving circuit 150 through the third group node N1*c* in the first light-emitting element string 141. Likewise, the current $I_2$ entering the second light-emitting element string 142 may not flow to the fourth light-emitting element group G2*d* in the second light-emitting element string 142 but may flow to the driving circuit 150 through the third group node N2*c* in the second light-emitting element string 142. Therefore, only the first to third light-emitting element groups G1*a* to G1*c* in the first light-emitting element string 141 and/or the first to third light-emitting element groups G2*a* to G2*c* in the second light-emitting element string 142 may be turned on. In addition, during a time between to and tf, the driving circuit 150 may provide a driving current $I_{DD}$ of a constant third current Ic to the light-emitting circuit 140.

The magnitude of the driving voltage $V_{DD}$ during a time between tf and tg may be sufficient to turn on two light-emitting element groups G1*a* and G1*b* in the first light-emitting element string 141 and two light-emitting element groups G2*a* and G2*b* in the second light-emitting element string 142, but may be too small to turn on three light-emitting element groups G1*a* to and G1*c* in the first light-emitting element string 141 and three light-emitting element groups G2*a* to G2*c* in the second light-emitting element string 142. Accordingly, at tf, the driving voltage sensing circuit 154 may turn on only the second group switching circuit 152. Accordingly, the current $I_1$ entering the first light-emitting element string 141 may not flow to the third light-emitting element group G1*c* in the first light-emitting element string 141 but may flow to the driving circuit 150 through the second group node N1*b* in the first light-emitting element string 141. Likewise, the current $I_2$ entering the second light-emitting element string 142 may not flow to the third light-emitting element group G2*c* in the second light-emitting element string 142 but may flow to the driving circuit 150 through the second group node N2*b* in the second light-emitting element string 142. Therefore, only the first and second light-emitting element groups G1*a* and G1*b* in the first light-emitting element string 141 and/or the first and second light-emitting element groups G2*a* and G2*b* in the second light-emitting element string 142 may be turned on. In addition, during a time between tf and tg, the driving circuit 150 may provide a driving current $I_{DD}$ of a constant second current Ib to the light-emitting circuit 140.

The magnitude of the driving voltage $V_{DD}$ during a time between tg and th may be sufficient to turn on one light-emitting element group G1*a* in the first light-emitting element string 141 and one light-emitting element group G2*a* in the second light-emitting element string 142, but may be too small to turn on two light-emitting element groups G1*a* and G1*b* in the first light-emitting element string 141 and two light-emitting element groups G2*a* and G2*b* in the second light-emitting element string 142. Accordingly, at tg, the driving voltage sensing circuit 154 may turn on only the first group switching circuit 151. Accordingly, the current $I_1$ entering the first light-emitting element string 141 may not flow to the second light-emitting element group G1*b* in the first light-emitting element string 141 but may flow to the driving circuit 150 through the first group node N1*a* in the first light-emitting element string 141. Likewise, the current $I_2$ entering the second light-emitting element string 142 may not flow to the second light-emitting element group G2*b* in the second light-emitting element string 142 but may flow to the driving circuit 150 through the first group node N2*a* in the second light-emitting element string 142. Therefore, only the first light-emitting element group G1*a* in the first light-emitting element string 141 and/or the first light-emitting element group G2*a* in the second light-emitting element string 142 may be turned on. In addition, during a time between tg and th, the driving circuit 150 may provide a driving current $I_{DD}$ of a constant first current Ia to the light-emitting circuit 140.

The magnitude of the driving voltage $V_{DD}$ during a time between th and $P_{DD}$ may be too small to turn on one light-emitting element group G1*a* in the first light-emitting element string 141 and one light-emitting element group G2*a* in the second light-emitting element string 142. Accordingly, during a time between th and $P_{DD}$, all of the first to fourth light-emitting element groups G1*a* to G1*d* in the first light-emitting element string 141 and all of the light-emitting element groups G2*a* to G2*d* in the second light-emitting element string 142 may be in an off state.

In this manner, by using a multi-step driving circuit (i.e., the driving circuit 150, which sequentially turns on and off light-emitting elements in the same light-emitting element string (for example, the first light-emitting element string 141 and/or the second light-emitting element string 142) in accordance with the driving voltage $V_{DD}$), the lighting apparatus 100 may achieve higher power factor, lower total harmonic distortion (THD), and higher light efficiency.

Referring back to FIG. 5, the blocking circuit 170 may include a plurality of diodes 171*a* to 171*c* and 172*a* to 172*c* connected between the driving circuit 150 and the light-emitting circuit 140. For example, the blocking circuit 170 may include a plurality of diodes 171*a* to 171*c* connected between the plurality of group nodes N1*a* to N1*c* in the first light-emitting element string 141 and the plurality of group switching circuits 151 to 153 of the driving circuit 150, respectively, and a plurality of diodes 172*a* to 172*c* connected between the plurality of group nodes N2*a* to N2*c* in the second light-emitting element string 142 and the plurality of group switching circuits 151 to 153 of the driving circuit 150, respectively.

The blocking circuit 170 may prevent an unintended light-emitting element from being turned on by preventing current from flowing from the driving circuit 150 to the light-emitting circuit 140. For example, when only the first light-emitting element group G1*a* of the first light-emitting element string 141 is intended to be turned on, the diode 172*a* may prevent current from flowing from the first group switching circuit 151 of the driving circuit 150 to the first group node N2*a* in the second light-emitting element string 142 and thus prevent the second to fourth light-emitting element groups G2*b* to G2*d* in the second light-emitting element string 142 from being unintentionally turned on.

Figure 7:
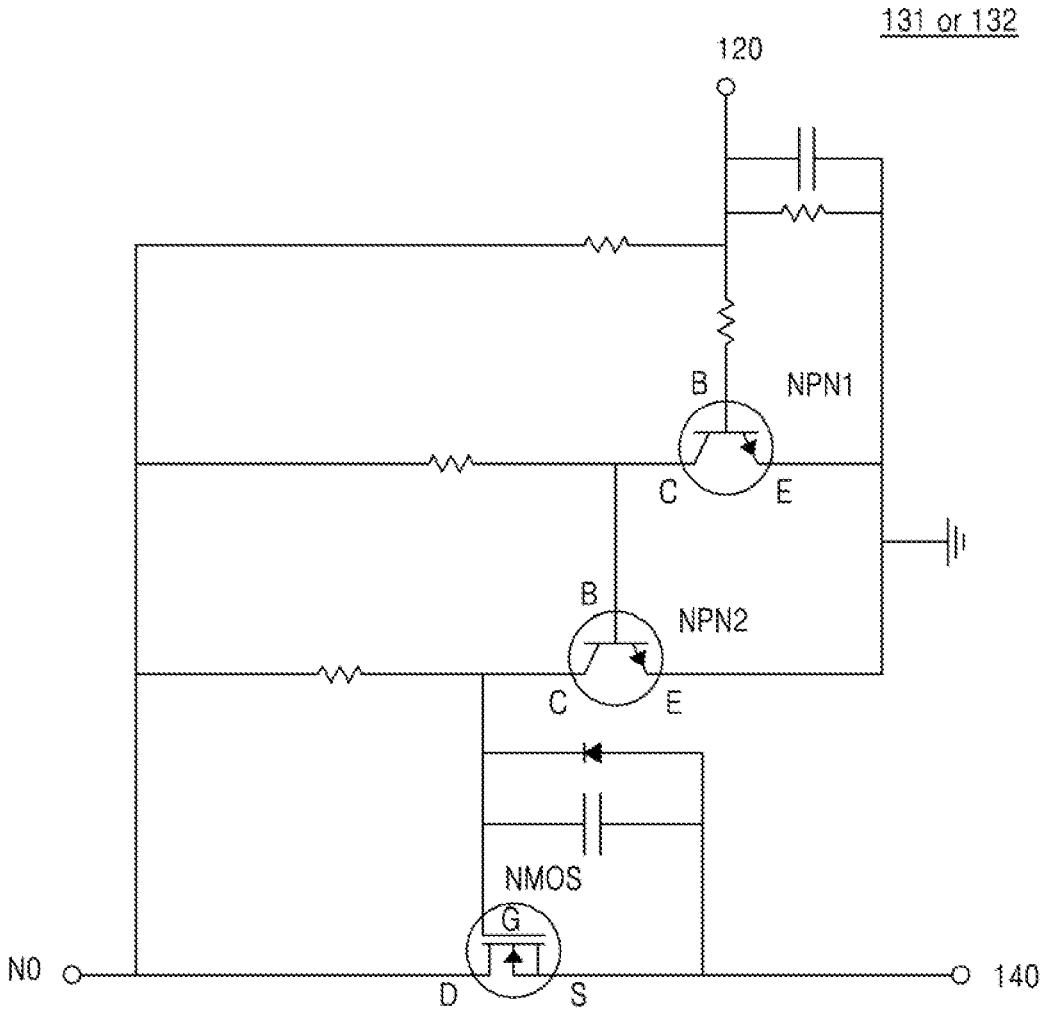
FIG. 7 is a schematic circuit diagram of a string switching circuit according to an example embodiment.
Figure 8:
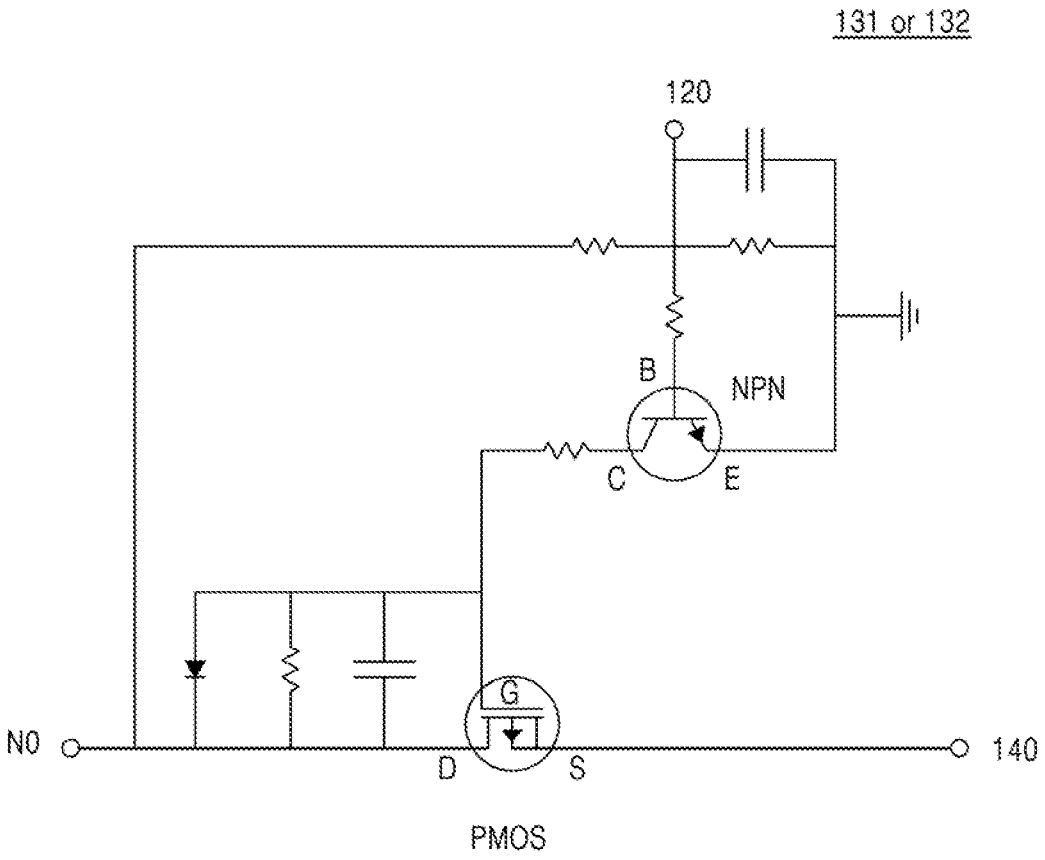
FIG. 8 is a schematic circuit diagram of a string switching circuit according to an example embodiment.

FIG. 7 is a schematic circuit diagram of a string switching circuit 131 or 132 according to an example embodiment. FIG. 8 is a schematic circuit diagram of a string switching circuit 131 or 132 according to an example embodiment.

Referring to FIGS. 7 and 8, the string switching circuit 131 or 132 may use a transistor rather than a mechanical switch. Therefore, the string switching circuit 131 or 132 may occupy a smaller volume. For example, the string switching circuit 131 or 132 may be designed using a metal oxide semiconductor field effect transistor (MOSFET) and/or a bipolar junction transistor (BJT). For example, the string switching circuit 131 or 132 shown in FIG. 7 may include an N-type MOSFET NMOS and first and second NPN-type BJTs NPN1 and NPN2. The string switching circuit 131 or 132 shown in FIG. 8 may include a P-type MOSFET PMOS and an NPN-type BJT NPN.

Referring to FIG. 7, while the off/on sensing circuit 120 does not provide an off voltage to the string switching circuit 131 or 132, a relatively high voltage may be provided to a base B of the first NPN-type BJT NPN1, and thus, the first NPN-type BJT NPN1 may be turned on. Accordingly, a relatively low voltage may be provided to a base B of the second NPN-type BJT NPN2, and thus, the second NPN-type BJT NPN2 may be turned on. Accordingly, a relatively high voltage may be provided to a gate G of the N-type MOSFET NMOS, and thus, the N-type MOSFET NMOS may be turned on. The N-type MOSFET NMOS in an on state may connect the light-emitting circuit 140 to the driving node N0. Therefore, the string switching circuit 131 or 132 may be on.

On the other hand, when the off/on sensing circuit 120 provides an off voltage (e.g., 0 volts) to the string switching circuit 131 or 132, a relatively low voltage may be provided to the base B of the first NPN-type BJT NPN1, and thus, the first NPN-type BJT NPN1 may be turned off. Accordingly, a relatively high voltage may be provided to the base B of the second NPN-type BJT NPN2, and thus, the second NPN-type BJT NPN2 may be turned on. Accordingly, a relatively low voltage may be provided to the gate G of the N-type MOSFET NMOS, and thus, the N-type MOSFET NMOS may be turned off. The turned-off N-type MOSFET NMOS may not connect the light-emitting circuit 140 to the driving node N0. Therefore, the string switching circuit 131 or 132 may be turned off.

Referring to FIG. 8, while the off/on sensing circuit 120 does not provide an off voltage to the string switching circuit 131 or 132, a relatively high voltage may be provided to a base B of the NPN-type BJT NPN, and thus, the NPN-type BJT NPN may be turned on. Accordingly, a relatively low voltage may be provided to a gate G of the P-type MOSFET PMOS to turn on the P-type MOSFET PMOS. The turned-on P-type MOSFET PMOS may connect the light-emitting circuit 140 to the driving node N0. Therefore, the string switching circuit 131 or 132 may be on.

On the other hand, when the off/on sensing circuit 120 provides an off voltage (e.g., 0 volts) to the string switching circuit 131 or 132, a relatively low voltage may be provided to the base B of the NPN-type BJT NPN, and thus, the NPN-type BJT NPN may be turned off. Accordingly, a relatively high voltage may be provided to the gate G of the P-type MOSFET PMOS, and thus, the P-type MOSFET PMOS may be turned off. The turned-off P-type MOSFET PMOS may not connect the light-emitting circuit 140 to the driving node N0. Therefore, the string switching circuit 131 or 132 may be turned off.

Figure 9:
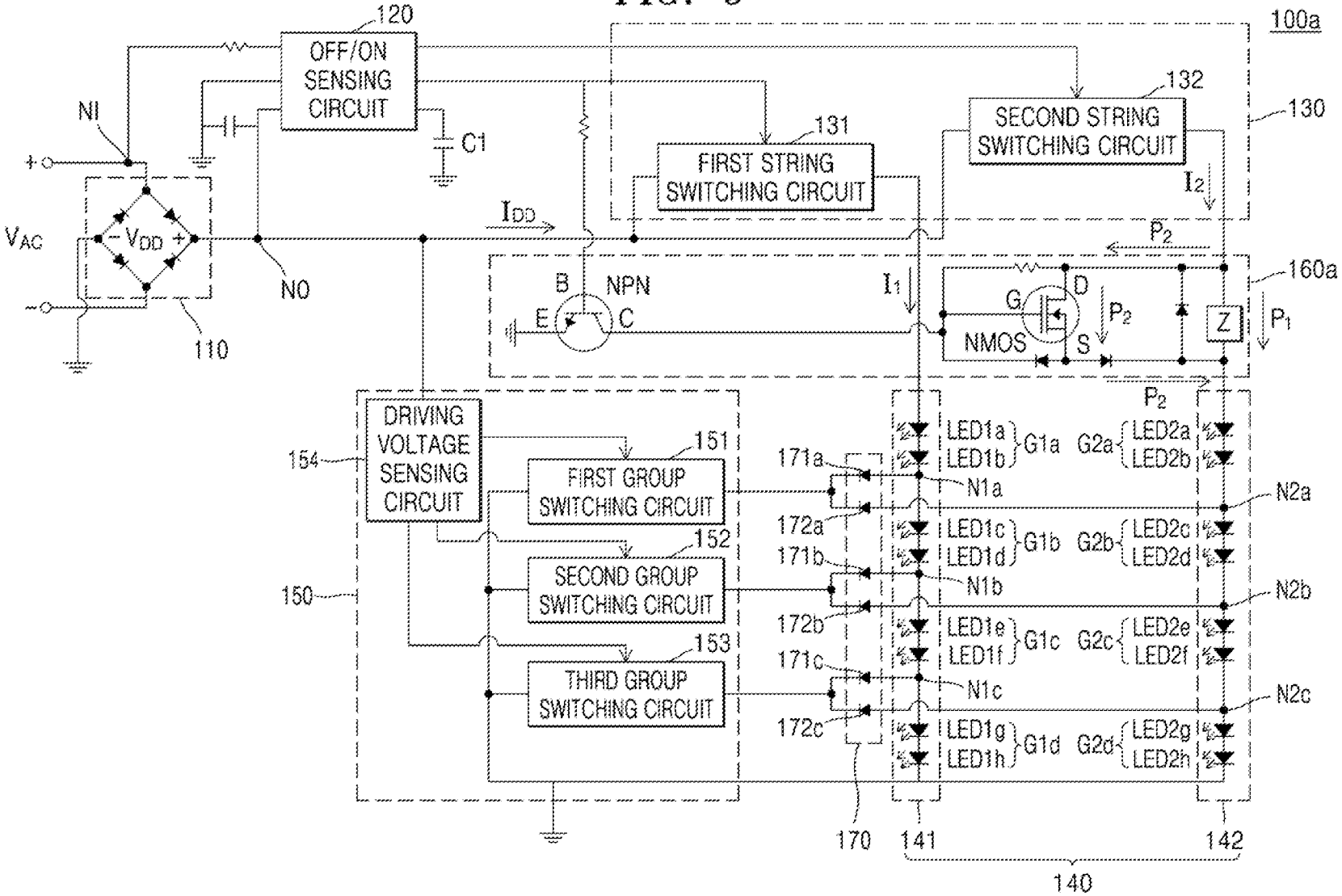
FIG. 9 is a schematic circuit diagram of a lighting apparatus according to an example embodiment.

FIG. 9 is a schematic circuit diagram of a lighting apparatus 100*a* according to an example embodiment.

Referring to FIG. 9, the lighting apparatus 100*a* may include a balancing circuit 160*a* instead of the balancing circuit 160 shown in FIG. 5. The balancing circuit 160*a* may include an impedance element Z between a second string switching circuit 132 and a second light-emitting element string 142, like the balancing circuit 160 shown in FIG. 5. The balancing circuit 160*a* may further include a bypass circuit configured to provide an electrical path that bypasses the impedance element Z. For example, while the off/on sensing circuit 120 does not provide an off voltage to a first string switching circuit 131, a relatively high voltage may be applied to a base B of an NPN-type BJT NPN, and thus, the NPN-type BJT NPN may be turned on. Accordingly, a relatively low voltage may be applied to a gate G of an N-type MOSFET NMOS to turn off the N-type MOSFET NMOS. Accordingly, a current $I_2$ supplied through the second string switching circuit 132 may flow to the second light-emitting element string 142 through a first path $P_1$ passing through the impedance element Z. On the other hand, when the off/on sensing circuit 120 provides an off voltage (e.g., 0 volts) to the first string switching circuit 131, a relatively low voltage may be applied to the base B of the NPN-type BJT NPN, and thus, the NPN-type BJT NPN may be turned off. Accordingly, a relatively high voltage may be applied to the gate G of the N-type MOSFET NMOS to turn on the N-type MOSFET NMOS. Accordingly, a current $I_2$ supplied through the second string switching circuit 132 may flow to the second light-emitting element string 142 through a second path $P_2$ bypassing the impedance element Z.

Accordingly, when the off/on sensing circuit 120 does not provide an off voltage to the first string switching circuit 131, that is, when both the first light-emitting element string 141 and the second light-emitting element string 142 are in an on state, the current $I_2$ supplied through the second string switching circuit 132 flows through the impedance element Z to the second light-emitting element string 142, and thus, the impedance element Z may contribute to the adjustment of the third color temperature. On the other hand, when the off/on sensing circuit 120 provides an off voltage to the first string switching circuit 131, that is, only the second light-emitting element string 142 is turned on, energy consumption by the impedance element Z may be prevented because the current $I_2$ supplied through the second string switching circuit 132 bypasses the impedance element Z and flows to the second light-emitting element string 142. Therefore, the lighting apparatus 100*a* according to the embodiment may achieve higher energy efficiency.

Figure 10:
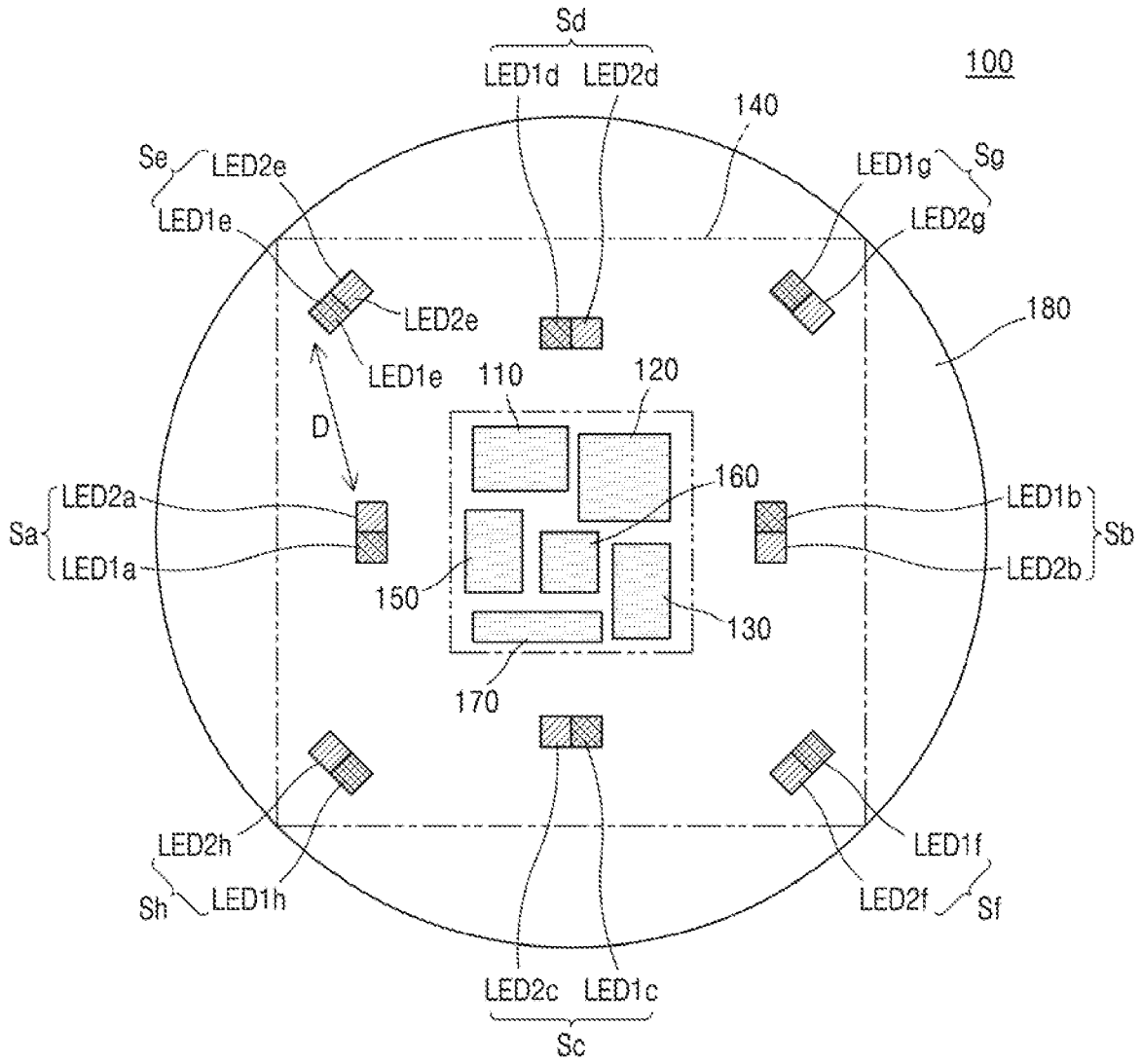
FIG. 10 is a schematic plan view of a lighting apparatus according to an example embodiment.

FIG. 10 is a schematic plan view of a lighting apparatus 100 according to an example embodiment.

Referring to FIG. 10, the lighting apparatus 100 may include a circuit board 180 and a rectifying circuit 110, an off/on sensing circuit 120, a string switching circuit 130, a light-emitting circuit 140, a driving circuit 150, a balancing circuit 160, and a blocking circuit 170, which are on the circuit board 180. The circuit board 180 may include conductive patterns that connect the rectifying circuit 110, the off/on sensing circuit 120, the string switching circuit 130, the light-emitting circuit 140, the driving circuit 150, the balancing circuit 160, and the blocking circuit 170. The circuit board 180 may be, for example, a printed circuit board (PCB).

Light-emitting elements LED1*a* to LED1*h* and LED2*a* to LED2*h* constituting the light-emitting circuit 140 may be evenly distributed at selected intervals on the circuit board 180 to provide light uniformity of the lighting apparatus 100. In an example embodiment, in order to provide uniformity of light having a third color temperature, which is obtained by mixing light having a first color temperature and light having a second color temperature, the light-emitting elements LED1*a* to LED1*h* constituting the first light-emitting element string 141 (see FIG. 5) and the light-emitting elements LED2*a* to LED2*h* constituting the second light-emitting element string 142 (see FIG. 5) may form pairs Sa to Sh one-to-one, and a first light-emitting element and a second light-emitting element in the same pair (e.g., the light-emitting element LED1*a* and the light-emitting element LED2*a* in the pair Sa) may be adjacent to each other. Thus, the distance between the first light-emitting element and the second light-emitting element in the same pair (e.g., the light-emitting element LED1*a* and the light-emitting element LED2*a* in the pair Sa) may be less than a spatial distance D between different pairs. In an example embodiment, the distance between the first light-emitting element and the second light-emitting element in the same pair (e.g., the light-emitting element LED1*a* and the light-emitting element LED2*a* in the pair Sa) may be minimized or zero. For example, the first light-emitting element and the second light-emitting element in the same pair (e.g., the light-emitting element LED1*a* and the light-emitting element LED2*a* in the pair Sa) may contact each other.

In an example embodiment, considering the order in which the light-emitting elements LED1*a* to LED and LED2*a* to LED2*h* are turned on over time, light-emitting elements in groups having the same order of connection from the driving node N0 may be determined as the same pair for light uniformity. For example, the light-emitting elements LED1*a* and LED1*b* in the first light-emitting element group G1*a* (see FIG. 5) in the first light-emitting element string 141 (see FIG. 5) may be paired with the light-emitting elements LED2*a* and LED2*b* in the first light-emitting element group G2*a* (see FIG. 5) in the second light-emitting element string 142 (see FIG. 5). In another example, unlike FIG. 10, the first light-emitting element LED1*a* in the first light-emitting element group G1*a* (see FIG. 5) in the first light-emitting element string 141 (see FIG. 5) may be paired with the second light-emitting element LED2*b* in the first light-emitting element group G2*a* (see FIG. 5) in the second light-emitting element string 142 (see FIG. 5).

In an example embodiment, the light-emitting elements LED1*a* to LED1*h* in the first light-emitting element string 141 and the light-emitting elements LED2*a* to LED2*h* in the second light-emitting element string 142 may form pairs according to the order in which the light-emitting elements LED1*a* to LED1*h* and the light-emitting elements LED2*a* to LED2*h* are connected to the driving node N0. Thus, as shown in FIG. 10, first to eighth light-emitting elements (i.e., the light-emitting elements LED1*a* to LED1*h*) in the first light-emitting element string 141 may form first to eighth pairs Sa to Sh in turn with first to eighth light-emitting elements (i.e., the light-emitting elements LED2*a* to LED2*h*) in the second light-emitting element string 142. By arranging the light-emitting elements LED1*a* to LED1*h* and LED2*a* to LED2*h* in the manner as described above, spatial and temporal light uniformity may be improved.

By way of summation and review, light-emitting elements emitting light having different correlated color temperatures (i.e., CCT) may be included in one lighting apparatus, and thus a CCT changeable lighting apparatus capable of emitting light having two or more color temperatures (CCTs) may be provided. The CCT changeable lighting apparatus may be implemented such that light having various color temperatures may be generated by one lighting apparatus according to a user's desire.

As described above, embodiments may provide a lighting apparatus operable to change a color temperature of light emitted from the lighting apparatus according to, e.g., an off/on signal of an alternating current (AC) power source.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A lighting apparatus, comprising:

a light-emitting circuit including a first light-emitting element string configured to emit light having a first color temperature and a second light-emitting element string configured to emit light having a second color temperature different from the first color temperature;

a rectifying circuit configured to rectify a voltage, input by an alternating current (AC) power source, to provide a driving voltage to a driving node;

a string switching circuit configured to select at least one light-emitting element string to be used for light emission from among the first light-emitting element string and the second light-emitting element string;

an off/on sensing circuit configured to change a selection of the string switching circuit to change a color temperature of light, which is emitted by the light-emitting circuit, when the AC power source is turned off and then turned on; and a driving circuit configured to turn on, in turn, light-emitting elements in the selected at least one light-emitting element string, according to a change in the driving voltage over time, wherein the string switching circuit includes a first string switching circuit configurable to selectively connect the first light-emitting element string to the driving node, and a second string switching circuit configurable to selectively connect the second light-emitting element string to the driving node, wherein each of the first light-emitting element string and the second light-emitting element string includes a plurality of light-emitting element groups connected in series and a plurality of group nodes between the plurality of light-emitting element groups, wherein the driving circuit is connected to the plurality of group nodes, and wherein the driving circuit includes a plurality of group switching circuits configurable to selectively connect the plurality of group nodes to a ground node, respectively, and a driving voltage sensing circuit configured to control the plurality of group switching circuits according to a magnitude of the driving voltage.

2. The lighting apparatus as claimed in claim 1, wherein, when the AC power source is turned on within a predetermined time after the AC power source is turned off, the off/on sensing circuit changes the selection of the string switching circuit, and when the AC power source is turned on after the predetermined time after the AC power source is turned off, the off/on sensing circuit does not change the selection of the string switching circuit.

3. The lighting apparatus as claimed in claim 1, further comprising a balancing circuit configured to adjust a third color temperature, the third color temperature being a color temperature of light emitted from the light-emitting circuit when both the first light-emitting element string and the second light-emitting element string are selected.

4. The lighting apparatus as claimed in claim 1, wherein the driving circuit is configured to change a driving current stepwise according to a change in the driving voltage over time, the driving current being provided to the selected at least one light-emitting element string to turn on, in turn, the light-emitting elements in the selected at least one light-emitting element string.

5. The lighting apparatus as claimed in claim 1, wherein the string switching circuit includes a metal oxide semiconductor field effect transistor.

6. The lighting apparatus as claimed in claim 1, wherein the string switching circuit includes a bipolar junction transistor.

7. The lighting apparatus as claimed in claim 1, wherein light-emitting elements in the first light-emitting element string are paired one-to-one with light-emitting elements in the second light-emitting element string, and a distance between a first light-emitting element and a second light-emitting element in a same pair is less than a distance between different pairs.

8. The lighting apparatus as claimed in claim 1, wherein the off/on sensing circuit changes the selection of the string switching circuit by selectively providing an off voltage to the string switching circuit.

9. A lighting apparatus, comprising:

a light-emitting circuit including a plurality of light-emitting element strings configured to emit light having respectively different color temperatures, each of the plurality of light-emitting element strings having a first end connected to a ground node, the plurality of light-emitting element strings including a first light-emitting element string configured to emit light having a first color temperature and a second light-emitting element string configured to emit light having a second color temperature different from the first color temperature;

a string switching circuit configurable to be in an on or off state, wherein, in the on state, a second end of each of the plurality of light-emitting element strings is connected to a driving node to which a driving voltage is provided, and, in the off state, the second end of each of the plurality of light-emitting element strings is not connected to the driving node; and an off/on sensing circuit configured to detect an off/on signal in which an alternating current (AC) power source is turned off and then turned on, and to change the state of the string switching circuit when the off/on signal is detected, wherein an output mode of the lighting apparatus is one of a plurality of modes in which color temperatures of light emitted by the light-emitting circuit are different from each other, and the output mode of the lighting apparatus is changed to another one of the plurality of modes by the off/on signal, wherein the string switching circuit includes a first string switching circuit configurable to selectively connect the first light-emitting element string to the driving node, and a second string switching circuit configurable to selectively connect the second light-emitting element string to the driving node, wherein each of the plurality of light-emitting element strings includes a plurality of light-emitting element groups connected in series and a plurality of group nodes between the plurality of light-emitting element groups, wherein the light apparatus further comprises a driving circuit connected to the plurality of group nodes, and wherein the driving circuit includes a plurality of group switching circuits configurable to selectively connect the plurality of group nodes to a ground node, respectively, and a driving voltage sensing circuit configured to control the plurality of group switching circuits according to a magnitude of the driving voltage.

10. The lighting apparatus as claimed in claim 9, wherein, when the AC power source is turned on after a predetermined time after the AC power source is turned off, the output mode of the lighting apparatus is not changed.

11. The lighting apparatus as claimed in claim 9, further comprising a balancing circuit connected between the string switching circuit and the light-emitting circuit.

12. The lighting apparatus as claimed in claim 9, further comprising a rectifying circuit configured to rectify a voltage input by the AC power source to provide the driving voltage to the driving node.

13. The lighting apparatus as claimed in claim 9, further comprising a blocking circuit including a plurality of diodes connected between the driving circuit and the light-emitting circuit.

14. A lighting apparatus, comprising:

a light-emitting circuit including a first light-emitting element string configured to emit light having a first color temperature and a second light-emitting element string configured to emit light having a second color temperature different from the first color temperature;

a first string switching circuit configurable to be in an on or off state, wherein, in the on state, the first light-emitting element string is connected to a driving node to which a driving voltage is provided, and, in the off state, the first light-emitting element string is not connected to the driving node;

a second string switching circuit configurable to be in an on or off state, wherein, in the on state, the second light-emitting element string is connected to the driving node, and, in the off state, the second light-emitting element string is not connected to the driving node; and an on/off sensing circuit configured to control the states of the first string switching circuit and the second string switching circuit, wherein an output mode of the lighting apparatus is one of a first mode in which only the first string switching circuit is in the on state, a second mode in which only the second string switching circuit is in the on state, and a third mode in which both the first string switching circuit and the second string switching circuit are in the on states, wherein the on/off sensing circuit changes the state of at least one of the first string switching circuit and the second string switching circuit, so as to change the output mode of the lighting apparatus to another one of the first to third modes, according to a predetermined order when an off/on signal, in which an alternating current power source is turned off and then turned on, is detected, wherein each of the first light-emitting element string and the second light-emitting element string includes a plurality of light-emitting element groups connected in a series and a plurality of group nodes between the plurality of light-emitting element groups, wherein the lighting apparatus further comprises a driving circuit connected to the plurality of group nodes, and wherein the driving circuit includes a plurality of group switching circuits configurable to selectively connect the plurality of group nodes to a ground node, respectively, and a driving voltage sensing circuit configured to control the plurality of group switching circuits according to a magnitude of the driving voltage.

15. The lighting apparatus as claimed in claim 14, further comprising a balancing circuit including an impedance element connected between the second string switching circuit and the second light-emitting element string.

16. The lighting apparatus as claimed in claim 15, wherein the balancing circuit further includes a bypass circuit configured to provide an electrical path that bypasses the impedance element when the output mode of the lighting apparatus is the second mode.

17. The lighting apparatus as claimed in claim 14, wherein:

first light-emitting elements in the first light-emitting element string are paired one-to-one with second light-emitting elements in the second light-emitting element string according to an order in which the first light-emitting elements and the second light-emitting elements are connected to the driving node, and a distance between a first light-emitting element and a second light-emitting element in a same pair is less than a distance between different pairs.

18. The lighting apparatus as claimed in claim 14, wherein each of the first string switching circuit and the second string switching circuit is configured to be placed in the off state by an off voltage received from the on/off sensing circuit.

* * * * *